US010315457B2

(12) United States Patent
Depoi et al.

(10) Patent No.: US 10,315,457 B2
(45) Date of Patent: Jun. 11, 2019

(54) ENVELOPE INSERTER WITH SUCTION CUP OPENING MECHANISM AND IMPROVED INSERTION MOTION CONTROL

(71) Applicant: DMT Solutions Global Corporation, Danbury, CT (US)

(72) Inventors: Arthur H. Depoi, Brookfield, CT (US); Anthony E. Yap, Danbury, CT (US)

(73) Assignee: DMT Solutions Global Corporation, Danbury, CT (US)

( * ) Notice: Subject to any disclaimer, the term of this patent is extended or adjusted under 35 U.S.C. 154(b) by 489 days.

(21) Appl. No.: 15/040,140

(22) Filed: Feb. 10, 2016

(65) Prior Publication Data

US 2016/0243883 A1 Aug. 25, 2016

Related U.S. Application Data

(60) Provisional application No. 62/118,542, filed on Feb. 20, 2015.

(51) Int. Cl.
*B43M 3/04* (2006.01)

(52) U.S. Cl.
CPC ..... *B43M 3/045* (2013.01)

(58) Field of Classification Search
CPC . B43M 3/00; B43M 3/02; B43M 3/04; B43M 3/045
USPC ..... 53/473, 569, 284.3, 381.5, 381.6, 381.7
See application file for complete search history.

(56) References Cited

U.S. PATENT DOCUMENTS 4,674,258 A * 6/1987 Ehlscheid ..... B43M 3/045 53/154
5,257,805 A * 11/1993 Belec ..... B65H 3/0883 271/107
5,388,388 A * 2/1995 Belec ..... B43M 3/045 53/460
5,517,797 A * 5/1996 Ballard ..... B43M 3/045 53/381.5
5,552,691 A * 9/1996 Pierce ..... G05B 19/416 198/718
5,560,185 A * 10/1996 Petkovsek ..... B43M 5/042 53/284.3
5,618,375 A * 4/1997 Suzuki ..... B43M 5/042 156/442.2
5,832,702 A * 11/1998 Jacobson ..... B43M 3/045 53/569

(Continued)

*Primary Examiner* — Gloria R Weeks
*Assistant Examiner* — Dariush Seif
(74) *Attorney, Agent, or Firm* — Brown Rudnick LLP

(57) ABSTRACT

A method for opening an envelope for insertion of a collation in an envelope inserting machine. The envelope is fed into an inserting station with its flap in an open position. The insertion station has vacuum belts to hold the envelope in position, and to move the envelope in an upstream or downstream direction. A suction cup is positioned above the envelope in the insertion station. The suction cup is moved downward to engage a top surface of the envelope near an upstream edge of the top surface. The suction cup then lifts the top surface of the envelope to open a throat of the envelope to facilitate insertion of a collation. The envelope on the vacuum belt is then moved in the upstream direction by a small amount so that the top surface of the envelope forms a more open angle for receiving the collation.

6 Claims, 2 Drawing Sheets

(56) References Cited

U.S. PATENT DOCUMENTS 5,924,265 A * 7/1999 Auerbach ..... B43M 3/045 53/381.6
6,036,185 A * 3/2000 Baumann ..... B43M 3/045 271/2
6,155,031 A * 12/2000 Ballestrazzi ..... B43M 3/04 53/381.5
6,164,043 A * 12/2000 Miller ..... B43M 3/045 53/381.6
6,199,348 B1 * 3/2001 Button ..... B43M 3/045 53/381.5
6,425,223 B1 * 7/2002 Miller ..... B43M 3/045 53/381.6
6,973,762 B2 * 12/2005 Miller ..... B43M 3/045 53/381.6
6,978,583 B2 * 12/2005 Rozenfeld ..... B43M 3/045 53/381.5
7,181,895 B1 * 2/2007 Rozenfeld ..... B43M 3/045 53/284.3
7,600,755 B1 * 10/2009 Rozenfeld ..... B43M 3/04 198/689.1
7,662,080 B2 * 2/2010 Kapturowski ..... B31F 1/10 271/2
8,281,919 B2 * 10/2012 Rozenfeld ..... B43M 3/045 198/571
8,439,182 B2 * 5/2013 Rozenfeld ..... B43M 3/045 198/571
2004/0123571 A1 * 7/2004 Rozenfeld ..... B43M 3/045 53/569
2005/0034433 A1 * 2/2005 Gomez ..... B43M 3/045 53/569
2006/0254223 A1 * 11/2006 Passoni ..... B43M 3/045 53/492
2007/0125045 A1 * 6/2007 Sytema ..... B43M 3/045 53/460
2009/0288373 A1 * 11/2009 Feijen ..... B43M 3/045 53/467
2010/0313530 A1 * 12/2010 Smith ..... B43M 3/045 53/569
2011/0099946 A1 * 5/2011 Fijnvandraat ..... B43M 3/045 53/381.5
2011/0203230 A1 * 8/2011 Heemstra ..... B43M 3/045 53/473
2013/0055686 A1 * 3/2013 Batzer ..... B43M 3/04 53/473
2013/0333333 A1 * 12/2013 Batzer ..... B43M 3/04 53/473
2014/0196414 A1 * 7/2014 Schempp ..... B43M 3/00 53/492
2017/0129274 A1 * 5/2017 Price-Stephens ..... B43M 3/02

* cited by examiner

ENVELOPE INSERTER WITH SUCTION CUP OPENING MECHANISM AND IMPROVED INSERTION MOTION CONTROL

FIELD OF THE INVENTION

The present invention relates generally to multi-station document inserting systems, which assemble batches of documents for insertion into envelopes. More particularly, the present invention is directed toward an envelope feeder-insert station having one or more suction cups for opening envelopes in preparation for insertion of documents.

BACKGROUND OF THE INVENTION

Multi-station document inserting systems generally include a plurality of various stations that are configured for specific applications. Typically, such inserting systems, also known as console inserting machines, are manufactured to perform operations customized for a particular customer. Such machines are known in the art and are generally used by organizations, which produce a large volume of mailings where the content of each mail piece may vary.

For instance, inserter systems are used by organizations such as banks, insurance companies and utility companies for producing a large volume of specific mailings where the contents of each mail item are directed to a particular addressee. Additionally, other organizations, such as direct mailers, use inserts for producing a large volume of generic mailings where the contents of each mail item are substantially identical for each addressee. Examples of such inserter systems are the MPS and Epic™ series inserter systems available from Pitney Bowes, Inc., Stamford, Conn.

In many respects the typical inserter system resembles a manufacturing assembly line. Sheets and other raw materials (other sheets, enclosures, and envelopes) enter the inserter system as inputs. Then, a plurality of different modules or workstations in the inserter system work cooperatively to process the sheets until a finished mailpiece is produced. The exact configuration of each inserter system depends upon the needs of each particular customer or installation. For example, a typical inserter system includes a plurality of serially arranged stations including an envelope feeder, a plurality of insert feeder stations and a burster-folder station. There is a computer generated form or web feeder that feeds continuous form control documents having control coded marks printed thereon to the burster-folder station for separating and folding. A control scanner located in the burster-folder station senses the control marks on the control documents. Thereafter, the serially arranged insert feeder stations sequentially feed the necessary documents onto a transport deck at each station as the control document arrives at the respective station to form a precisely collated stack of documents which is transported to the envelope feeder-insert station where the stack is inserted into the envelope. The transport deck preferably includes a ramp feed so that the control documents always remain on top of the stack of advancing documents. A typical modern inserter system also includes a control system to synchronize the operation of the overall inserter system to ensure that the collations are properly assembled.

With regard to the envelope feeder-insert station, they are critical to the operation of document inserting systems. Typically, such an envelope insert device inserts collated enclosures into a waiting envelope. At the insert station, one or more suction devices can be used to pull open an envelope so that it is ready to receive a collation of documents. Prior art insert stations use open loop actuators (air cylinders) that open a fixed amount. Depending on the collation thickness, the fixed opening amount may not be best suited for a particular job. Also, depending on the width of the envelope, the suction cups may have to be manually moved across the throat of the envelope for optimum opening. The same setting may not work for both a narrow envelope and a wide envelope. This adjustment is typically manual and can be difficult to adjust correctly for untrained operators.

Conventional insert stations are shown in the following U.S. patents, which are hereby incorporated by reference:

- U.S. Pat. No. 6,978,583—High Speed Vacuum System for Inserters;
- U.S. Pat. No. 7,181,895—Jam Tolerant Mail Inserter;
- U.S. Pat. No. 7,600,755—System and Method for Preventing Envelope Distortion in a Mail Piece Fabrication System;
- U.S. Pat. No. 8,281,919—System for Controlling Friction Forces Developed on an Envelope in a Mailpiece Insertion Module;
- U.S. Pat. No. 8,439,182—Mail Piece Inserter Including System for Controlling Friction Forces Developed on an Envelope.

SUMMARY OF THE INVENTION

Accordingly, the instant invention provides a method for opening an envelope for insertion of a collation in an envelope inserting machine. An envelope is fed into an inserting station with its flap in an open position. The insertion station has vacuum belts to hold the envelope in position, and to move the envelope in an upstream or downstream direction. A suction cup is positioned above the envelope in the insertion station. The suction cup is moved downward to engage a top surface of the envelope near an upstream edge of the top surface. The suction cup then lifts the top surface of the envelope to open a throat of the envelope to facilitate insertion of a collation. The envelope on the vacuum belt is then moved in the upstream direction by a small amount so that the top surface of the envelope forms a more open angle for receiving the collation. The amount of movement can be in the range of 2 to 5 millimeters, preferably around 3 millimeters.

Upon initially lifting the suction cup, a region of the top surface of the envelope where the vacuum cup is engaged is tilted at a closed angle. Thus, the height of the opening to the envelope throat at the upstream edge is reduced. The upstream movement of the envelope by the vacuum belt causes the top surface of the envelope where the vacuum cup is engaged to tilt from a closed angle to an open angle. Thereby the problem is resolved and the height of the opening of the envelope is increased.

The collation is then inserted into the envelope that is being held open by action of the suction cup. The vacuum cup is released after insertion of the collation into the envelope. The envelope is transported on the vacuum belt in the downstream direction.

BRIEF DESCRIPTION OF THE DRAWINGS

The above and other objects and advantages of the present invention will become more readily apparent upon consideration of the following detailed description, taken in conjunction with accompanying drawings, in which like reference characters refer to like parts throughout the drawings and in which.

DETAILED DESCRIPTION OF THE PREFERRED EMBODIMENT

Envelope Inserter with Variably Activated Suction Cups

Figure 1:
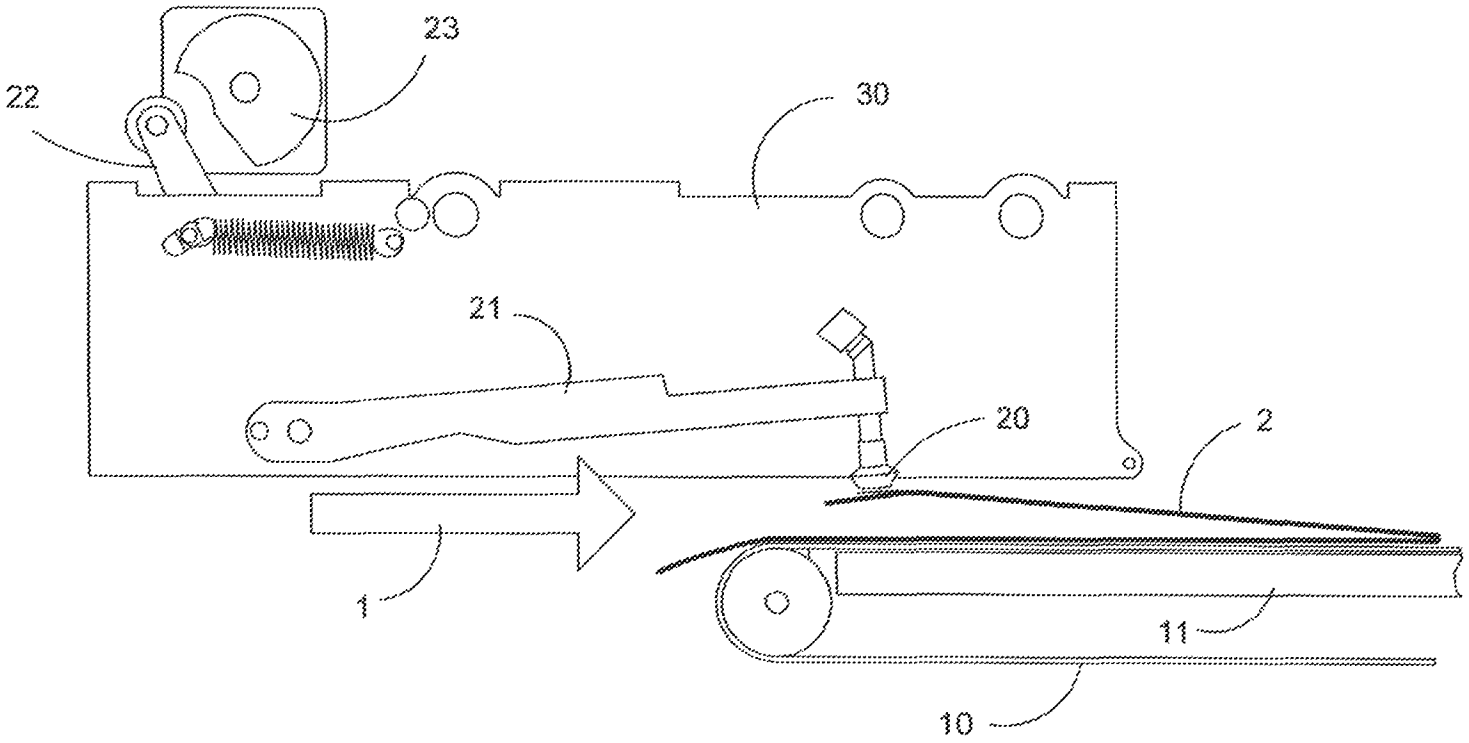
FIG. 1 is a side view showing of an insert station in which the upper side of the envelope has an undesirable closed angle at the opening.

FIG. 1 shows an exemplary inserter station on which the improved motion control can be implemented. An envelope 2 to be opened by the suction cup 20 is supported on a vacuum deck 11 and a belt transport 10. The vacuum cup 20 is mounted on a mounting arm 21 that is fixedly attached to cam follower arm 22. Together, the mounting arm 21 and the cam follower arm 22 form a pivoting arm. A cam follower is mounted on the end of cam follower arm 22, and is in operative contact with cam 23, which controls the up and down motion of suction cup 20, through the pivot arm. A more extensive description for a preferred embodiment for controlling one or more suction cups 20 is described in co-pending application: Envelope Inserter With Variably Activated Suction Cups, Ser. No. 62/118,548, filed Feb. 20, 2015, and commonly assigned to Pitney Bowes Inc., which is hereby incorporated by reference.

As seen in FIG. 1, in this arrangement, the cups 20 have a tendency to bend the top leading edge of the throat of the envelope 2 in a closed angle as it is lifted open due to geometry of the suction cup arms 21. This reduces the opening height of the envelope 2 and presents a catch point to the incoming collation from direction 1. This could be mitigated by increasing the opening height of the suction cups 20. However, opening the envelope 2 higher tends to reduce the opening width, and makes insertion of collation that has a width approaching the envelope width more difficult.

Figure 2:
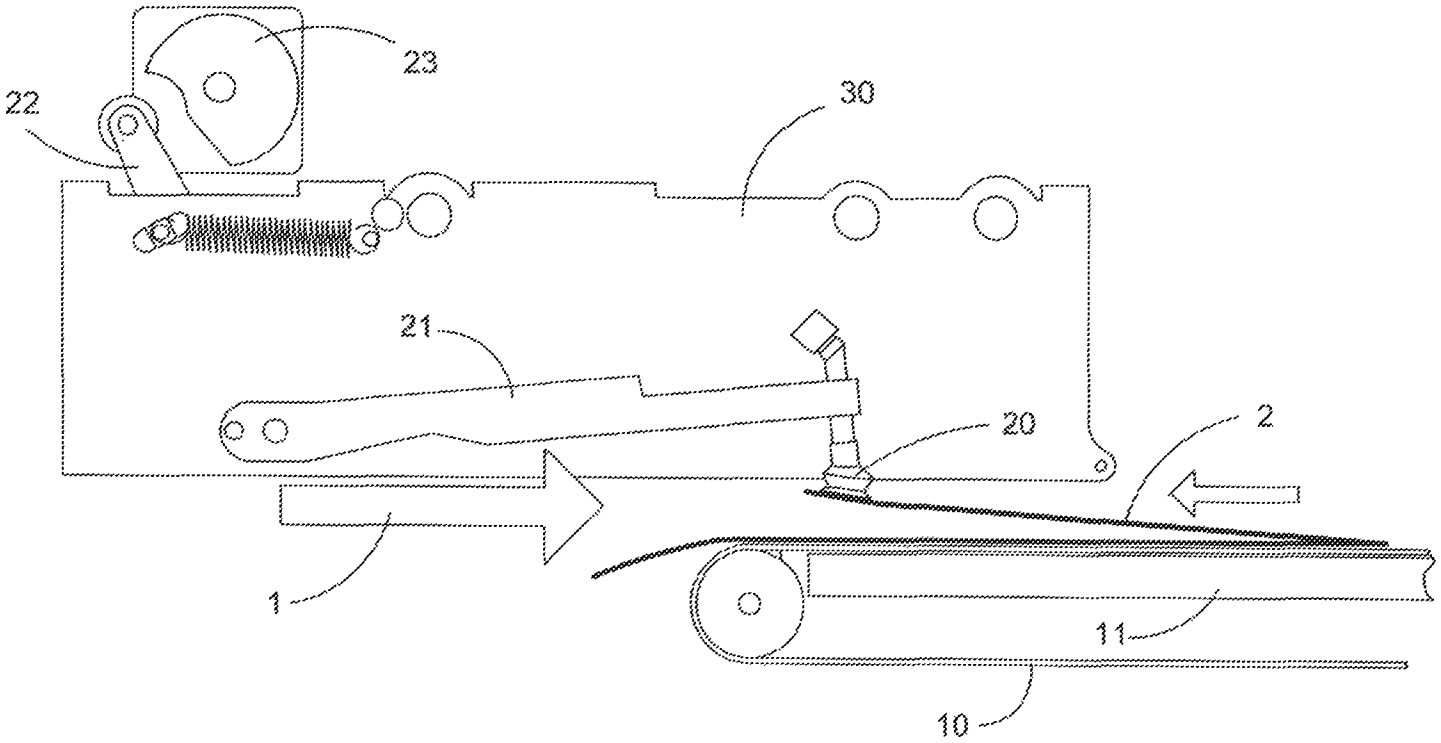
FIG. 2 is a side view depicting the preferred embodiment in which the upper side of the envelope has been adjusted to a more open angle at the opening.

As seen in FIG. 2, the proposed improvement solves the problem by introducing a small reverse motion to the envelope 2 via vacuum belt 10 after the suction cups 20 have acquired the envelope 2. Then, the cups 2 will bend the leading edge of the throat open, which is preferable as it presents a more favorable entrance geometry for an incoming collation from direction 1. A small reverse motion on the vacuum belts 10, in the order of 2 to 5 mm, causes the suction cups 20 will slightly deform and cause the throat of the envelope 2 to bend to a more open angle, increasing the clearance for the incoming collation. A movement of envelope 2 by approximately 3 mm to the left has been found to have the most advantageous effect. Performing this operation increases the size of the opening of the envelope 2 with no impact on the throughput of the machine. This has the benefit of increasing insertion reliability, which will reduce machine stoppages and enhance productivity.

Although the invention has been described with respect to preferred embodiments thereof, it will be understood by those skilled in the art that the foregoing and various other changes, omissions and deviations in the form and detail thereof may be made without departing from the spirit and scope of this invention.

What is claimed is:

1. A method for opening an envelope for insertion of a collation in an envelope inserting machine, the method including;

feeding an envelope into an inserting station with its flap in an open position, the insertion station having vacuum belts to hold the envelope in position, and to move the envelope in an upstream or downstream direction;

positioning a suction cup above the envelope in the insertion station:

moving the suction cup downward to engage a top surface of the envelope near an upstream edge of the top surface;

lifting the suction cup and the top surface of the envelope to open a throat of the envelope to facilitate insertion of a collation;

moving the envelope on the vacuum belt in the upstream direction by a small amount prior to inserting the collation so that the top surface of the envelope forms a more open angle for receiving the collation; and after the step of moving the envelope on the vacuum belt, inserting the collation into the envelope that is being held open by action of the suction cup.

2. The method of claim 1 wherein the step of moving the envelope in the upstream direction includes moving the envelope in the range of 2 to 5 millimeters.

3. The method of claim 2 wherein the step of moving the envelope in the upstream direction includes moving the envelope approximately 3 millimeters.

4. The method of claim 1 wherein upon initially lifting the suction cup a region of the top surface of the envelope where the vacuum cup is engaged is tilted at a closed angle, whereby a height of an opening to the envelope throat at the upstream edge is reduced.

5. The method of claim 4 wherein the upstream movement of the envelope by the vacuum belt causes the top surface of the envelope where the vacuum cup is engaged to tilt from a closed angle to an open angle, whereby the height of the opening of the envelope throat at the upstream edge is increased.

6. The method of claim 1, further including the step of releasing the vacuum cup after insertion of the collation into the envelope and transporting the envelope on the vacuum belt in the downstream direction.

* * * * *